United States Patent [19]

Linstromberg

[11] 4,344,295

[45] Aug. 17, 1982

[54] CONTROL FOR TIMED OPERATION OF ICE MAKER

[75] Inventor: William J. Linstromberg, Lincoln Township, Berrien County, Mich.

[73] Assignee: Whirlpool Corporation, Benton Harbor, Mich.

[21] Appl. No.: 227,264

[22] Filed: Jan. 22, 1981

[51] Int. Cl.[3] ..... F25D 21/06

[52] U.S. Cl. ..... 62/155; 62/233

[58] Field of Search ..... 62/155, 233, 234, 135

[56] References Cited

U.S. PATENT DOCUMENTS

| | | | |
|---|---|---|---|
| 2,888,808 | 6/1959 | Jacobs | 62/234 X |
| 3,541,806 | 11/1970 | Jacobs | 62/233 |
| 3,643,458 | 2/1972 | Linstromberg et al. | 62/155 |
| 3,648,478 | 3/1972 | Linstromberg | 62/233 X |
| 3,659,430 | 5/1972 | Nichols et al. | 62/233 |
| 3,714,794 | 2/1973 | Linstromberg et al. | 62/233 X |
| 3,855,812 | 12/1974 | Linstromberg | 62/233 X |
| 3,864,933 | 2/1975 | Bright | 62/233 X |
| 3,964,269 | 6/1976 | Linstromberg | 62/233 X |

*Primary Examiner*—William E. Tapolcai, Jr.

*Attorney, Agent, or Firm*—Wegner, McCord, Wood & Dalton

[57] ABSTRACT

A refrigeration apparatus having an ice making mechanism and structure for operating the mechanism to deliver ice therefrom at timed intervals. The apparatus includes means for defrosting the apparatus. Further structure is provided for causing the length of the timed ice making intervals to be increased to include the amount of time required to effect the defrosting of the apparatus plus a preselected amount of time. In the illustrated embodiment, a timer, including a timer motor, is provided for controlling operation of the ice making mechanism. An electrical circuit is provided for electrically interconnecting components of the apparatus whereby the timer motor is energized concurrently with the operation of the compressor of the refrigeration apparatus and is de-energized concurrently with the operation of the defrost heater of the apparatus.

19 Claims, 2 Drawing Figures

CONTROL FOR TIMED OPERATION OF ICE MAKER

BACKGROUND OF THE INVENTION

1. Field of the Invention

This invention relates to a refrigeration apparatus having ice making mechanism and in particular to means for controlling the timing of an ice making cycle.

2. Description of the Prior Art

In U.S. Pat. No. 3,648,478, which patent is owned by the assignee hereof, the inventor herein disclosed a defrost control utilizing a single timer motor for cyclically driving an ice maker and timing a series of defrost and refrigeration operations. The timer motor is connected alternatively in parallel with and in series with the compressor motor of the apparatus in effecting the desired control. The circuit of the control allows the timer motor to be energized during operation of the defrost heater and provides a fixed off time for the refrigeration apparatus during each defrosting operation, regardless of how long the defrost heater was actually energized. Operation of the defrost heater, in turn, is controlled by a thermally responsive bimetallic switch. The opening of the bimetallic switch is controlled by the temperature condition of the apparatus being heated by the defrost heater and, thus, the timer in this control runs for a variable amount of time during which the defrost heater is energized. The inclusion of this defrost time in the timing of the ice making cycle has been found to be undesirable as it represents a time interval during which ice making in the ice making apparatus is impaired. It is desirable that the water in the ice maker tray is completely frozen at the end of the timed ice making cycle and it has been found that this can be assured by eliminating from the timed operation of the timer the time interval during which the defrost heater is energized.

In another U.S. patent owned by the assignee hereof, namely U.S. Pat. No. 3,714,794 of William J. Linstromberg et al., the ice maker utilizes a similar control wherein the timer motor and defrost heater are connected in parallel during the defrost operation so that the timer remains on during the defrost period.

In U.S. Pat. No. 3,643,458 also owned by the assignee hereof, William J. Linstromberg et al disclose an ice maker having a separate ice maker timer motor and a defrost timer motor. The ice maker timer motor is effectively connected in parallel with the defrost heater during the defrost operation and connected in series with the defrost bimetallic switch.

In U.S. Pat. No. 3,964,269 of William J. Linstromberg, which patent is also owned by the assignee hereof, an ice maker apparatus is shown wherein the timer motor is continuously operated during the energization of the defrost heater by means of a double throw, double pole switch controlled by operation of the timer. Concurrently with throwing of the switch to effect connection of the defrost heater for energization thereof, the switch connects the timer motor in parallel therewith to continue the timing operation. The circuit is further arranged so that the defrost bimetal switch controlling operation of the defrost heater does not affect operation of the timer motor and, thus, the timer motor continues to operate until the end of the defrost time cycle notwithstanding the de-energization of the defrost heater by the defrost bimetal switch.

SUMMARY OF THE INVENTION

The present invention comprehends an improved control circuit for an ice maker in a refrigeration apparatus wherein a timer motor is utilized for controlling the ice making mechanism and is de-energized during the energization of the defrost heater during the defrost cycle so as to avoid accumulation of defrost time as part of a timed ice making cycle. This is accomplished by providing means for extending a timed ice making cycle by an interval that is substantially equal to that required for a defrosting operation. Thus, the timed ice making cycle is caused to correspond more accurately with the time during which ice is actually being formed in the ice making apparatus by eliminating from the timing operation the time during which the refrigeration system has been deenergized during a defrosting cycle.

The invention provides a further advantage in that the amount of time the refrigeration unit is off during a defrosting operation is variable and is only slightly greater than the energization time of the defrost heater. This reduction in off time minimizes the temperature rise that normally takes place within a refrigeration apparatus during a defrosting operation.

Specifically, the invention comprehends the provision in a refrigeration apparatus having a common timing means for controlling an ice making mechanism and controlling the initiation of defrosting operations of a simple control circuit to de-energize the timing means upon energization of a defrost heater and re-energize the timing means upon de-energization of the defrost heater.

More specifically, the invention comprehends the provision in a refrigeration apparatus having components including a compressor motor, a defrost heater, a defrost switch having a run position and a defrost position, an ice making mechanism, a timer including a timer motor for selectively operating the defrost switch and timing ice harvesting operations of said ice making mechanism, and a temperature responsive switch responsive to a temperature condition resulting from energization of the defrost heater, of an improved circuit means for electrically interconnecting the components to cause the timer motor to be energized concurrently with the compressor motor when the defrost switch is in the run position and to cause the timer motor to be deenergized as a result of the defrost switch being moved to the defrost position to energize the defrost heater, but wherein the timer motor will be re-energized as a result of the temperature responsive switch terminating energization of the defrost heater while the defrost switch remains in the defrost position.

In the illustrated embodiment, the timer motor is energized in series with the temperature responsive switch and in parallel with the compressor when the defrost switch is in the run position. When the defrost switch is in the defrost position the circuit connections are changed such that the timer motor is energized through a series connection with the defrost heater and compressor, with the temperature responsive switch being connected so as to shunt the timer motor and prevent its operation until such time as the temperature responsive switch opens.

Further in the illustrated embodiment, the control includes thermal fuse for preventing continued energization of the defrost heater in the event of a failure of the temperature responsive switch to terminate energization of the defrost heater, notwithstanding the existence of a high temperature condition caused by energization of the defrost heater which would normally cause the temperature responsive switch to terminate the energization.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
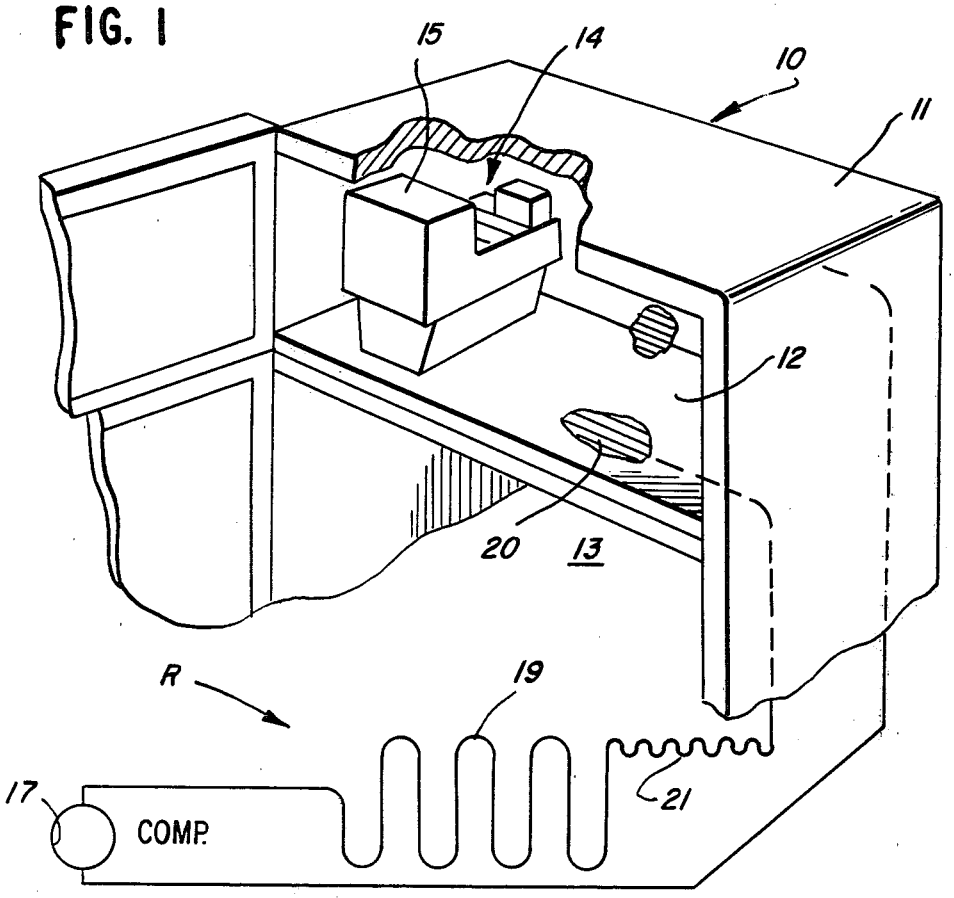
FIG. 1 is a fragmentary perspective view of a refrigeration apparatus having an ice making mechanism embodying the invention.

In the exemplary embodiment of the invention as disclosed in the drawing, a refrigeration apparatus generally designated 10 includes a cabinet 11 defining a freezer compartment 12 and a refrigeration space 13. A conventional ice making mechanism generally designated 14 is mounted in the freezer space 12 and is arranged to automatically form ice bodies. The ice making apparatus includes a control portion 15 housing a timer provided with a timer motor 16. The timer motor further operates the ice making mechanism 14 so as to periodically eject the formed ice bodies from the ice maker mechanism after a predetermined amount of timer run time has been accumulated and automatically initiate a subsequent ice making operation.

Refrigeration apparatus 10 further includes refrigeration means, generally designated R, including a conventional compressor 17, having a compressor motor 18, for providing compressed refrigerant to a condenser 19. The refrigerant fluid is fed from the condenser 19 to an evaporator 20 through a capillary 21 in the normal manner.

Figure 2:
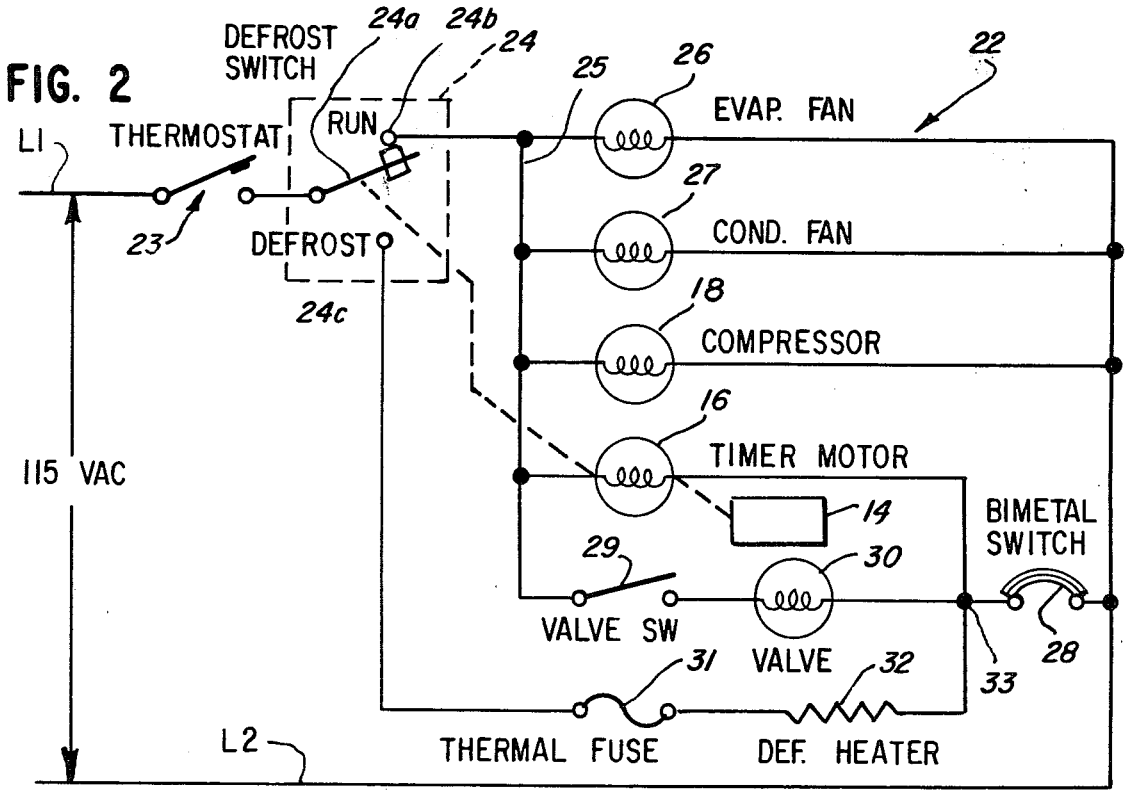
FIG. 2 is a schematic wiring diagram of the control circuit embodying the invention.

As indicated briefly above, the invention herein is concerned with the provision of an improved control circuit 22 which causes the timed cycle of the ice making apparatus to correspond more accurately to the cooling operations of the refrigeration apparatus 10. Referring more specifically to FIG. 2, control circuit 22 includes a cabinet thermostat switch 23 connected to couple head L1 of an AC power source to a moving contact 24*a* of a defrost switch 24. The defrost switch comprises a single pole, double throw switch having a first fixed contact 24*b* and a second fixed contact 24*c* selectively engaged by the moving contact 24*a*. Switch contact 24*b* is connected to a lead 25. Connected in parallel between lead 25 and the opposite power supply lead L2 are an evaporator fan motor 26, a condenser fan motor 27, and the compressor motor 18.

Timer motor 16 is connected from lead 25 through a temperature responsive bimetal switch 28 to power supply lead L2. Temperature responsive switch 28 is normally closed and disposed in thermal association with evaporator 20 so as to sense the temperature thereof. In parallel with timer motor 16 between lead 25 and switch 28 is a series connection of the water supply valve switch 29 and a water supply valve solenoid 30.

Connected between defrost switch fixed contact 24*c* and temperature responsive switch 28 is a series connection of a thermal fuse 31 and the defrost heater 32 for periodically defrosting evaporator 20.

As indicated in FIG. 2, timer motor 16 is mechanically connected in a conventional manner to the ice making apparatus 14 so as to effect the cyclical operation thereof and is mechanically connected to the defrost switch 24 of the control 22 for effecting timed operation thereof by means of a conventional timing cam (not shown).

During normal operation of the refrigeration apparatus, compressor motor 18 is energized through defrost switch 24 upon closing of thermostat switch 23 when the sensed temperature in cabinet 11 rises above a preselected level. Thus, a cooling cycle is initiated for refrigerating the apparatus and timer motor 16 is energized. Successive cooling cycles will take place under control of thermostat 23 and switch 24 will remain disposed in the full line, or run, position of FIG. 2 until such time as operation of timer motor 16 causes moving contact 24*a* to move from fixed contact 24*b* to the defrost position, in engagement with contact 24*c*, thereby de-energizing the compressor motor 18 as well as motors 26,27 and timer motor 16.

Defrost heater 32 will now be energized through the thusly thrown switch 24 and thermostat switch 23 until such time as the temperature responsive switch 28 senses a high temperature condition indicating that frost has been removed from the evaporator 20, whereupon switch 28 opens to prevent further energization of the defrost heater. It should be noted that during the time the switch 28 is closed, the series connection of timer motor 16 and compressor motor 18 between the point 33 and power supply lead L2 is shorted out by the switch 28. Thus, timer motor 16 is effectively precluded from operation during such energization of defrost heater 32 by the shunting action of switch 28.

However, when switch 28 opens to discontinue further energization of the defrost heater, the short circuit across the series connection of timer motor 16 and compressor motor 18 no longer exists. As the impedance of defrost heater 32 and compressor motor 18 are relatively low, the circuit from switch 24 through heater 32, timer motor 16, and compressor motor 18 allows the timer motor 16 to be energized, thereby causing operation of the timer while the compressor motor 18 and defrost heater 32 are de-energized.

After a relatively brief amount of additional timing operation of the timer; the timer causes switch 24 to be thrown back to the full line position of FIG. 2, breaking the circuit through the defrost heater 32. Since thermostat switch 23 is closed, return of switch 24 to the full line position of FIG. 2 initiates the refrigeration cycle wherein the compressor motor 18, evaporator fan motor 26, and condenser fan motor 27 are energized in the normal manner. At this point, timer 16 will again be de-energized because switch 28 will still be open and will remain open for several minutes until the temperature drops below its trip point. This further delay of timer 16 is desirable, because the temperature within the refrigeration apparatus will be somewhat higher than desired for ice making for a short period following a defrost operation.

Upon return of the temperature responsive switch 28 to the closed condition illustrated in FIG. 2, timer motor 16 is again energized in parallel with the compressor motor 18 to continue the timing operation of the ice making cycle. When a predetermined amount of timer run time, such as two hours, has been accumulated, the mechanism 14 operates to eject the completed ice bodies from the ice maker and initiate a subsequent making of further ice bodies by suitable delivery of water to the ice making mechanism by closing of valve switch 29 for controlled energization of the water valve solenoid 30. After a preselected period of time during which the desired quantity of water is delivered to the ice making mechanism, the timer opens valve switch 29, permitting the ice making cycle to be repeated in the normal manner.

Thermal fuse 31 is provided to open the circuit to defrost heater 32 in the event that the switch 28 fails in its closed position during a defrost operation.

Thus, the invention comprehends an improved control circuit 22 wherein the timer motor 16 is normally connected so as to accumulate compressor run time under the control of the cabinet thermostat 23. During the defrosting operation, however, circuit 22 automatically prevents energization of the timer motor while the defrost heater is energized so as to cause the timing of the ice making cycle to correspond more directly to the time during which temperature conditions are most favorable for ice making.

In the illustrated embodiment, the timer operation may be preselected to provide approximately three to five minutes of operation of the timer motor 16 subsequent to the opening of the switch 28 to effect the throwing of switch 24 back to the full line position of FIG. 2.

As is obvious to those skilled in the art, the time during which defrost heater 32 is energized in order to effect a defrosting operation varies with the amount of frost deposited. Typically, the period of energization will fall within a range of 10–20 minutes. Thus, the circuit 22 provides an automatic timing compensation which is directly proportional to the amount of heat energy developed by the defrost heater 32 during the defrost operation. The invention comprehends an improved arrangement of circuit components, such as utilized in U.S. Pat. No. 3,648,478, with the simple addition of the safety thermal fuse 31. Thus, the refrigeration control apparatus of the present invention is extremely simple and economical of construction while yet providing the highly desirable improved timing function discussed above.

The foregoing disclosure of specific embodiments is illustrative of the broad inventive concepts comprehended by the invention.

Having described the invention, the embodiments of the invention in which an exclusive property or privilege is claimed are defined as follows:

1. In a refrigeration apparatus having an ice making mechanism including means for operating said mechanism to deliver ice therefrom at timed ice making intervals, and means for defrosting the apparatus for a variable period of time, the improvement comprising:

means for increasing the length of a timed ice making cycle during which a defrosting operation takes place by a variable amount of time substantially equal to that of the defrosting operation.

2. The refrigeration apparatus of claim 1 wherein said means for operating said ice making mechanism comprises a timer motor connected to mechanically drive said mechanism and said means for increasing said timed ice making cycle includes circuit means for terminating operation of said timer motor during a defrosting operation.

3. The refrigeration apparatus of claim 2 wherein said circuit means comprises a temperature responsive switch responsive to heat generated by said defrosting means and connected so as to prevent energization of said timer motor until a predetermined temperature indicating completion of the defrosting operation is sensed.

4. The refrigeration apparatus of claim 3 wherein said temperature responsive switch comprises a normally closed bimetal switch connected so as to shunt said timer motor during a defrosting operation.

5. The refrigeration apparatus of claim 4 wherein said bimetal switch is further connected in series with said defrosting means such that said switch operates to concurrently re-energize said timer motor and de-energize said defrosting means when said predetermined temperature is sensed.

6. In a refrigeration apparatus including defrosting means, an ice making mechanism, and timing means for determining the length of an ice making cycle, the improvement comprising:

circuit means operative upon energization of said defrosting means to de-energize said timing means and operative upon de-energization of said defrosting means to re-energize said timing means.

7. The refrigeration apparatus of claim 6 wherein said circuit means comprises a temperature responsive switch connected to shunt said timing means until a predetermined temperature is sensed.

8. The refrigeration apparatus of claim 7 wherein said temperature responsive switch is further connected to de-energize said defrosting means when said predetermined temperature is sensed.

9. In a refrigeration apparatus operated from a source of electrical power and including refrigeration means, defrosting means, a defrost switch having a run position and a defrost position, an ice making mechanism, a timer motor operatively connected to said defrost switch and said ice making machanism, and a normally closed temperature responsive switch arranged to open at a predetermined temperature indicative of the completion of a defrosting operation, the improvement comprising:

circuit means operative when said defrost switch is in said defrost position for (a) connecting said defrost means and said temperature responsive switch in series across said power source, and (b) connecting said timer motor and said refrigeration means in series with each other and in parallel with said temperature responsive switch.

10. The refrigeration apparatus of claim 9 wherein said refrigeration means and said defrosting means have impedances sufficiently low so as to permit operation of said timer motor when said temperature responsive switch is open.

11. The refrigeration apparatus of claim 10 wherein said defrost means comprises a resistive heating element.

12. The refrigeration apparatus of claim 11 wherein said refrigeration means includes a compressor.

13. The refrigeration apparatus of claim 9 wherein said timer motor operates to return said defrost switch to said run position at a predetermined interval after the opening of said temperature responsive switch.

14. The refrigeration apparatus of claim 13 wherein said predetermined interval is substantially shorter than the length of a defrost operation.

15. In a refrigeration apparatus having refrigeration means, defrosting means, a defrost switch operative between a run position and a defrost position, an ice making mechanism, a timer operatively connected to said ice making mechanism and to said defrost switch to initiate a defrosting operation upon the accumulation of a predetermined amount of refrigeration apparatus run time, and a normally closed temperature responsive switch arranged to open at a temperature indicative of the completion of a defrost operation, the improvement comprising:

circuit means connecting said defrost means, said timer, and said temperature responsive switch to:

(a) de-energize said timer and energize said defrost means upon movement of said defrost switch to said defrost position;

(b) re-energize said timer and de-energize said defrost means upon the opening of said temperature responsive switch, whereby said timer operates to return said defrost switch to said run position; and, (c) de-energize said timer upon return of said defrost switch to said run position until said temperature responsive switch returns to its closed position.

16. The refrigeration apparatus of claim 15 wherein the interval during which said timer is re-energized to return said defrost switch to said run position is substantially less than the length of an ice making cycle.

17. The refrigeration apparatus of claim 15 wherein said timer operates said ice making mechanism to initiate an ice harvesting operation after a predetermined amount of timer run time.

18. In a refrigeration apparatus having an ice making mechanism and common timing means for controlling the initiation of defrosting operations and the operation of said ice making mechanism, an improved control circuit comprising:

a source of electrical power having first and second terminals;

a defrost switch having a moving contact receiving power from said first power source terminal and movable between a run contact and a defrost contact;

refrigeration means connected between said run contact and said second power source terminal;

a timer motor operatively connected to said movable defrost switch contact and arranged to control the cyclic operation of said ice making mechanism, said timer motor having a first terminal connected to said run contact and having a second terminal;

a normally closed temperature responsive switch arranged to open at a temperature indicative of the completion of a defrosting operation and being connected between said second timer motor terminal and said second power source terminal; and, a defrost heater connected between said defrost contact and said second timer motor terminal.

19. The refrigeration apparatus of claim 18 wherein said refrigeration apparatus includes an evaporator and said temperature responsive switch senses the temperature of said evaporator.

* * * * *